US005529174A

United States Patent [19]

McQueeny

[11] Patent Number: 5,529,174

[45] Date of Patent: Jun. 25, 1996

[54] PRODUCT PACKAGE

[75] Inventor: Thomas P. McQueeny, Chicago, Ill.

[73] Assignee: R. R. Donnelley & Sons Company, Chicago, Ill.

[21] Appl. No.: 325,772

[22] Filed: Oct. 17, 1994

[51] Int. Cl.[6] ..... B65D 79/00

[52] U.S. Cl. ..... 206/749; 206/320; 206/576; 206/774

[58] Field of Search ..... 206/45.13, 45.18, 206/45.16, 45.19, 320, 576, 578, 579, 457

[56] References Cited

U.S. PATENT DOCUMENTS

| | | | |
|---|---|---|---|
| 1,859,401 | 5/1932 | Lengsfield | 206/45.13 |
| 3,840,113 | 10/1974 | Bartleson | 206/232 |
| 4,026,411 | 5/1977 | Johnson | 206/45.19 |
| 4,163,559 | 8/1979 | Stenstrom | 206/579 |
| 4,413,726 | 11/1983 | Davidson | 206/45.13 |
| 4,614,266 | 9/1986 | Moorhead | 40/313 |

FOREIGN PATENT DOCUMENTS

| | | | |
|---|---|---|---|
| 308402 | 3/1929 | United Kingdom | 206/45.13 |

*Primary Examiner*—David T. Fidei

*Attorney, Agent, or Firm*—Marshall, O'Toole, Gerstein, Murray & Borun

[57] ABSTRACT

In order to enhance the desirability of packaging for products, and particularly the packaging for portable cellular telephones, a unique and improved product package is disclosed. The package includes a compartment for receiving the product which is defined at least in part by a side wall and a bottom wall. The compartment has a recess generally conforming in shape to the shape of the product. The package also includes a lid overlying the compartment to normally restrict access to the product during shipment and sale thereof. The lid is movable from a closed compartment position to an open compartment position by a purchaser of the product. The package includes a spring for elevating at least a portion of the product from the recess in the compartment. The spring operates when the lid has been moved from the closed compartment position to the open compartment position. The package thus enhances the visibility of the product in the compartment to the purchaser thereof. In a highly preferred embodiment, the package is such that an audible signal relating to the product is produced when the lid has been moved from the closed compartment position to the open compartment position.

23 Claims, 2 Drawing Sheets

PRODUCT PACKAGE

FIELD OF THE INVENTION

The present invention is generally directed to packaging and, more particularly, a package for a product such as a portable cellular telephone.

BACKGROUND OF THE INVENTION

Over the years, it is generally well known that the field of packaging has evolved with the products that are to be sold within the packaging. It is known, for instance, that packaging of all types has become much more sophisticated in recent years to not only provide extremely effective packaging for shipping shelf display purposes but also packaging which actually serves to assist in the successful marketing as well as enjoyment of the product itself. In fact, the field of packaging has reached such a level of sophistication that it is regarded as having great marketing significance.

More specifically, the packaging for a product is known to be an important factor in overall product marketing efforts. The fact is that consumers are inundated with such a proliferation of different products and packages that there is great competition among companies to attract initial attention of consumers by reason of their packaging and to thereafter retain attention of consumers for subsequent purchases of the same or related goods in the future. In many cases, this can spell the difference between success and failure regardless of the quality of a product or products of a given company.

However, it has remained the case that the conventional requirements for packaging must still be successfully achieved. This means that the packaging must be protective of the contents, both during shipping and while positioned on the store shelf. With regard to portable cellular telephones, it is certainly important for the product and related accessories to be protected by the packaging.

The present invention is directed to overcoming one or more of the foregoing problems and achieving one or more of the resulting objects.

SUMMARY OF THE INVENTION

It is, therefore, a principal object of the present invention to provide an entirely unique new product package. It is another object of the present invention to provide such a package for a portable cellular telephone and accessories. It is a further object of the present invention to provide a product package which provides enhanced product presentation.

Accordingly, the present invention is directed to a package for a product wherein the package includes a compartment for receiving the product defined at least in part by a side wall and a bottom wall. The compartment is formed such that it has a recess generally conforming in shape to the shape of the product. The package also includes a lid overlying the compartment to normally restrict access to the product during shipment and sale thereof. The lid is movable from a closed compartment position to an open compartment position by a purchaser of the product. The package further includes means for elevating at least a portion of the product from the recess in the compartment. More specifically, this occurs when the lid is moved from the closed compartment to the open compartment position to enhance visibility of the product in the compartment to the purchaser thereof.

In the exemplary embodiment, the package includes means associated with the lid for producing an audible signal relating to the product when the lid has been moved from the closed compartment to the open compartment position. It is also advantageous for many applications for the compartment to be generally rectangular in shape, having an open top, and the side wall defining the compartment preferably includes four side wall portions integral with the bottom wall thereof. Still additionally, the lid can be hinged to either the side wall or the bottom wall which, together, define the compartment for thereby pivoting the lid from the closed compartment to the open compartment position.

Preferably, the package includes an insert disposed within the compartment generally conforming to the side wall to provide a false bottom within the compartment generally spaced above the bottom wall. With this arrangement, the recess in the compartment is formed in the insert, and the elevating means advantageously comprises spring means disposed within the recess so as to be positioned under the product.

In a highly advantageous application, the package is specifically designed for utilization with a portable cellular telephone. The package then preferably further includes means for automatically producing an audible telephone ringing signal whenever the lid has been moved from the closed compartment to the open compartment position thereof. As will be appreciated, the lid will be so moved by a purchaser of the telephone in order to gain access to it after the purchase of the telephone.

In a highly preferred embodiment, the means associated with the lid for automatically producing an audible telephone ringing signal includes chip/switch means for producing the audible telephone tinging signal for a preselected time when the lid is moved from the closed compartment to the open compartment position.

As for other details of the invention, the compartment is preferably a generally rectangularly shaped box having an open top, and the side wall defining the compartment includes four side wall portions integral with and perpendicular to the bottom wall thereof. The lid is integrally hinged to one of the side wall portions defining the side wall so as to be able to pivot the lid from the closed compartment position to the open compartment position thereof. Still more specifically, the package is such that the side wall portion to which the lid is integrally hinged is also advantageously integrally hinged to the bottom wall for movement from the closed compartment to the open compartment position to enhance the ability to open and close the package.

With this arrangement the chip/switch means is preferably integrally disposed in overlapping relation to the integrally hinged side wall portion and the bottom wall for movement from a "switch on" position to a "switch off" position. The chip/switch means is advantageously in the "switch off" position when the integrally hinged side wall portion is perpendicular to the bottom wall of the compartment in the compartment closed position and is in the "switch on" position when the integrally hinged side wall portion is pivoted with the lid from the compartment closed to the compartment open position thereof. In other respects, the integrally hinged side wall portion preferably includes opposed accordion side wall folds which are integral with adjacent side wall portions for movement from a folded, closed position to an expanded, open position.

In a most highly preferred embodiment, the recess for the telephone is formed in an insert generally conforming to the side wall of the compartment to provide the false bottom for supporting the telephone above the bottom wall of the compartment. Still more specifically, the insert is preferably formed to have a top wall disposed intermediate a top edge of the side wall and the bottom wall of the compartment for positioning an operation manual over the top wall of the insert and the telephone therein.

With this arrangement, the spring means is advantageously disposed within the recess in the insert within the compartment so as to be disposed between the false bottom and the telephone. This serves well for automatically elevating one end relative to the other end of the telephone from the recess in the insert within the compartment when the lid has been moved from the closed compartment to the open compartment position. As a result, the spring means will be understood to serve the important function of enhancing the visibility of the telephone within the compartment to the purchaser after the opening of the package.

As for other details, the package may include at least one additional recess in the insert for a telephone battery and may also include at least one additional recess in the insert for a battery charging unit for the telephone battery.

Other objects, advantageous and features of the present invention will become apparent from a consideration of the following specification taken in conjunction with the accompanying drawings.

DETAILED DESCRIPTION OF THE PREFERRED EMBODIMENT

Figure 1:
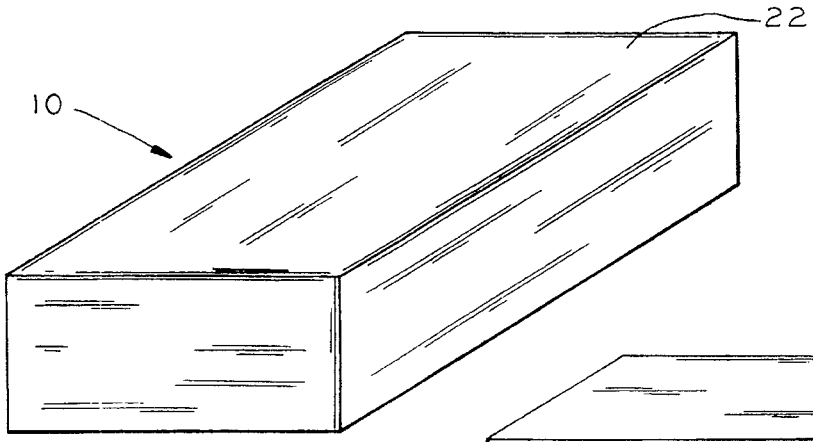
FIG. 1 is a perspective view of a package for a product with the lid in a compartment closed position in accordance with the present invention.

In the illustrations given, and with reference first to FIGS. 1–4, the reference numeral 10 designates generally a package which is particularly suited for use with a product such as a portable cellular telephone 12. The package 10 includes a compartment 14 for receiving the telephone 12 which is defined, at least in part, by a side wall generally designated 16 and a bottom wall 18, and the compartment 14 has a recess 20 generally conforming in shape to the shape of the telephone 12. As will also be appreciated by comparing FIGS. 1, 2 and 3, the package 10 includes a lid 22 overlying the compartment 14 in order to normally restrict access to the telephone 12 during shipment and sale thereof.

Figure 2:
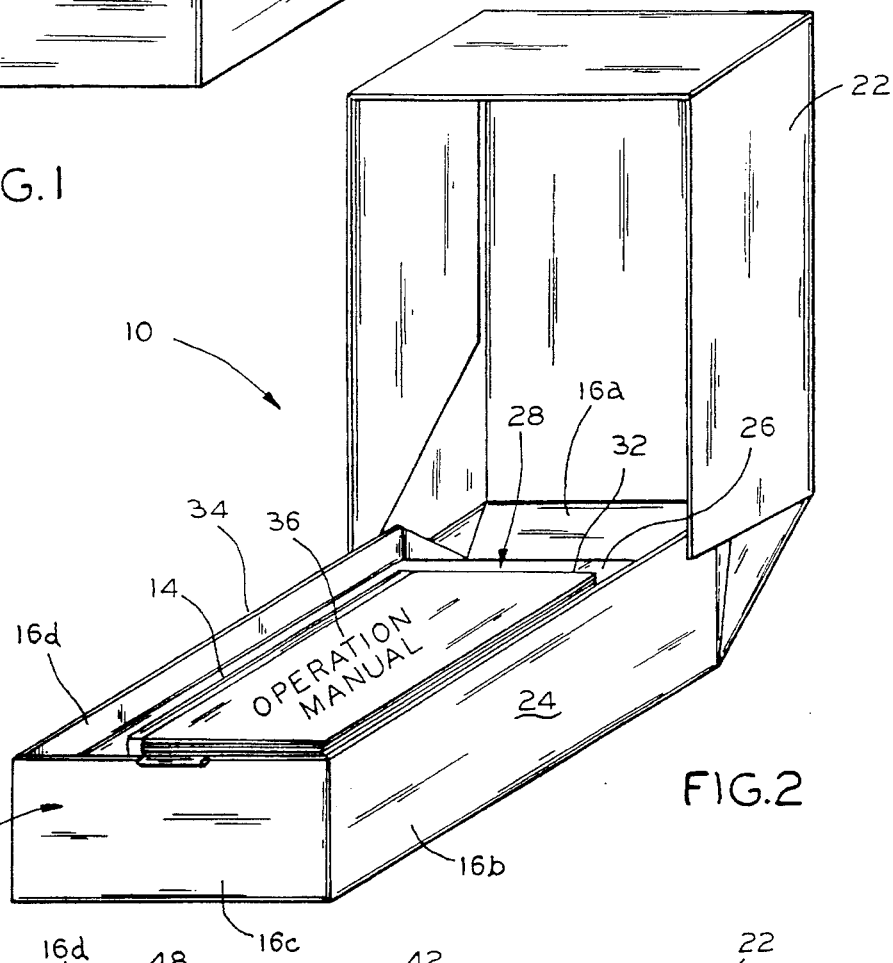
FIG. 2 is a perspective view of the package for a product, as illustrated in FIG. 1, but with the lid moved to a compartment open position.
Figure 3:
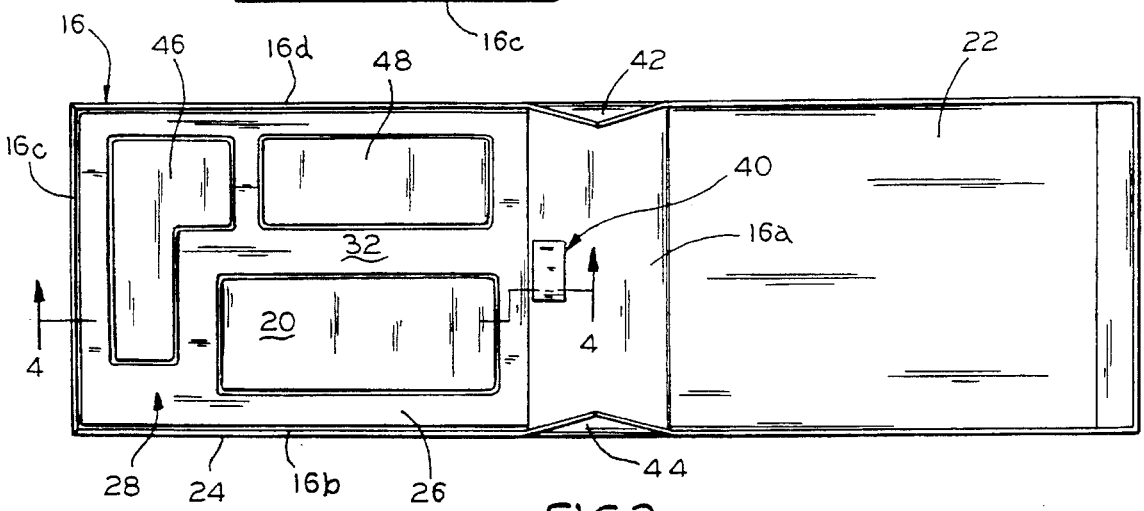
FIG. 3 is a top plan view of the package for a product, as illustrated in FIG. 2, but with the operation manual removed.

Referring to FIG. 3, it will be seen that the compartment 14 is defined by a generally rectangularly shaped box 24 having an open top 26 and the side wall 16 of the box 24 includes four side wall portions **16*a*, 16*b*, 16*c* and 16*d* integral with and perpendicular to the bottom wall 18 thereof. As will be understood from FIGS. 2 and 3, the lid 22 is integrally hinged to one of the side wall portions 16*a* defining the side wall 16 so as to be able to pivot the lid 22 from a closed compartment position (as shown in FIG. 1) to an open compartment position (as shown in FIG. 2**).

Figure 4:
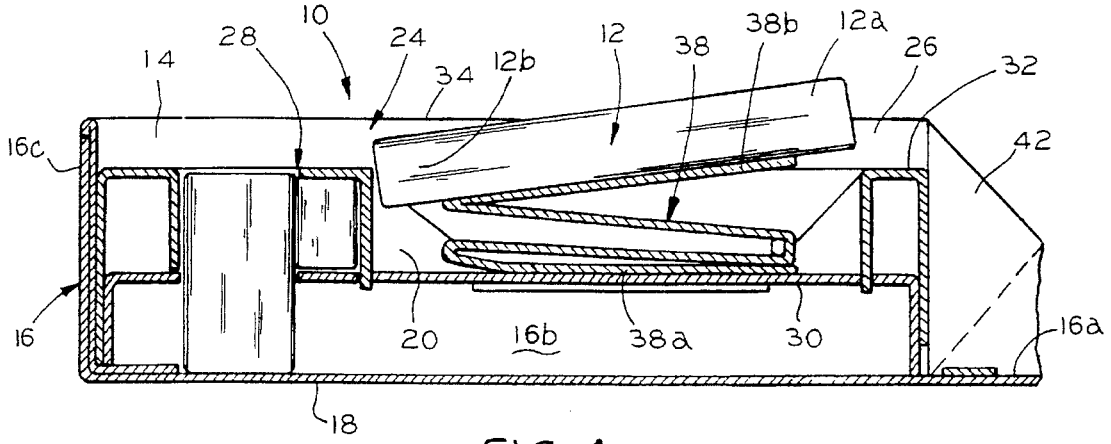
FIG. 4 is a cross-sectional view taken along the line 4—4 of FIG. 3 illustrating the package in use with a portable cellular telephone.

Referring specifically to FIG. 4, the recess 20 is formed in an insert 28 generally conforming to the side wall 16 of the compartment 14 to provide a false bottom 30 for supporting the telephone 12 above the bottom wall 18 of the compartment 14. The lid 22 is movable from the closed compartment position (FIG. 1) to the open compartment position (FIG. 2) by a purchaser of the telephone 12 in order to gain access to the telephone 12 supported by the false bottom 30 of the insert 28. As will be appreciated by referring to FIGS. 3 and 4, the insert 28 has a top wall 32 disposed intermediate a top edge 34 of the side wall 16 and the bottom wall 18 of the compartment 14 to allow an operation manual 36 to be placed over the top wall 32 of the insert 28 and the telephone 12.

Figure 5:
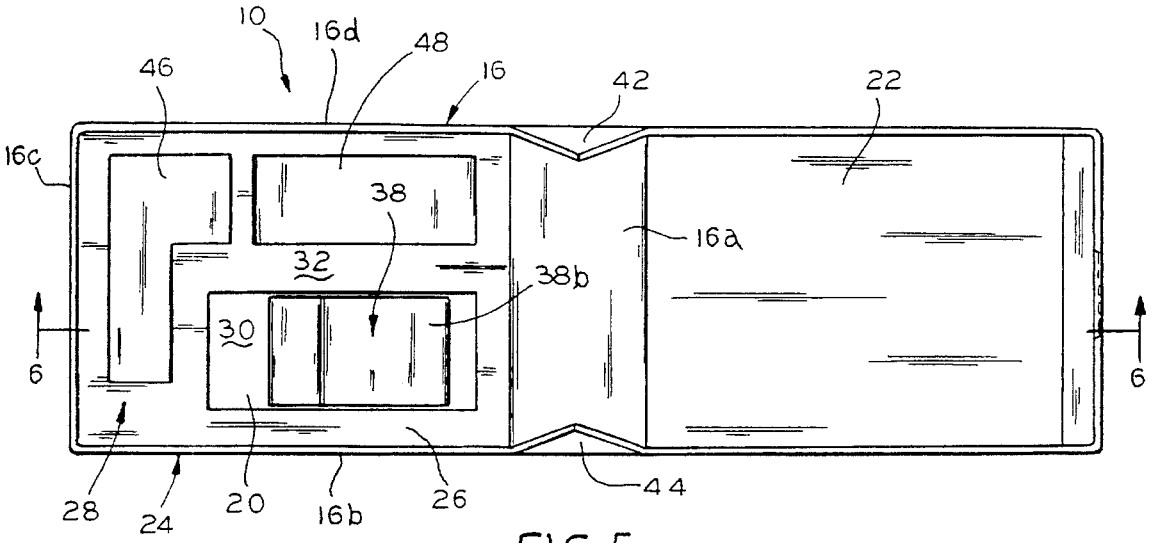
FIG. 5 is a top plan view of the package for use with a portable cellular telephone as illustrated in FIG. 4, with the telephone removed from the package.
Figure 6:
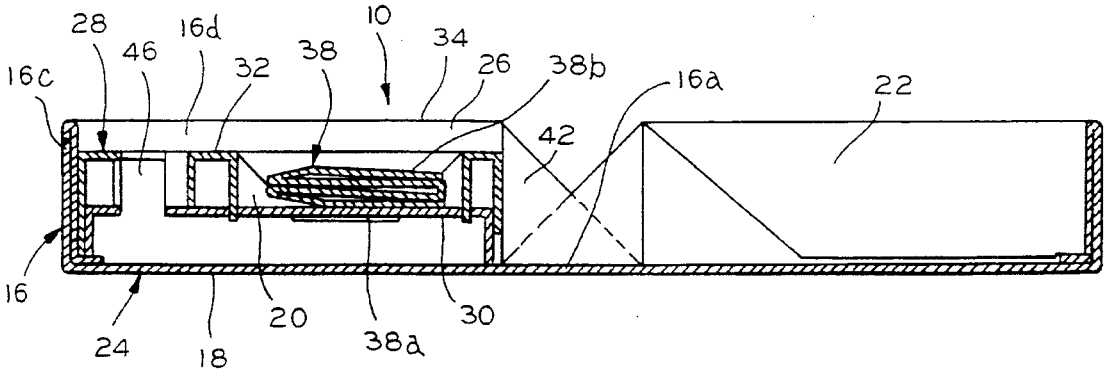
FIG. 6 is a cross-sectional view taken along the line 6—6 of FIG. 5 illustrating the internal construction of the package in accordance with the present invention.

Referring to FIGS. 4–6, the package 10 also includes spring means generally designated 38 which is disposed within the recess 20 in the compartment 14 so as to be positioned between the false bottom 30 and the telephone 12 for elevating one end **12*a* relative to the other end 12*b* of the telephone 12. It will be appreciated that the spring means 38 causes the telephone 12 to be automatically elevated from the recess 20 in the compartment 14 substantially as shown in FIG. 4 after the lid 22 has been moved from the closed compartment position (see, e.g., FIG. 1) to the open compartment position (see, e.g., FIG. 2). Of course, the spring means 38 will only become fully operative when the operation manual 36 has been removed from the compartment 14 which will then naturally enhance the visibility of the telephone 12 in the compartment 14 to the purchaser by elevating it from the recess 20**.

In a highly unique and preferred embodiment, the package 10 includes means associated with the lid 22 for automatically producing an audible signal such as that of a telephone ringing. This is advantageously achieved by utilizing chip/switch means generally designated 40 (see FIG. 3) which is capable of automatically producing the audible telephone ringing signal for a preselected period of time. More specifically, the chip/switch means 40 causes this to occur whenever the lid 22 is moved from the closed compartment position (FIG. 1) to the open compartment position (FIG. 2).

By comparing FIGS. 2 and 3, the specific details of construction of the rectangular box 24 as well as the manner in which it cooperates with the lid 22 will be more fully understood. It will be seen that the side wall portion **16*a* to which the lid 22 is integrally hinged is also integrally hinged to the bottom wall 18 for movement from the compartment closed position (FIG. 1) to the compartment open position (FIG. 2). It will also be seen that the integrally hinged side wall portion 16*a* includes opposed accordion side wall folds 42 and 44 integral with adjacent side wall portions 16*b* and 16*d* for movement from a folded, closed position to an expanded, open position. With this arrangement, the chip/switch means 40 is integrally disposed in overlapping relation to the side wall portion 16*a* and the bottom wall 18** for movement from a "switch off" position to a "switch on" position.

Still more specifically, the chip/switch means 40 is preferably in the "switch off" position when the integrally hinged side wall portion **16*a* is perpendicular to the bottom wall 18 of the compartment 14 in the compartment closed position (FIG. 1). On the other hand, the chip/switch means 40 is preferably in the "switch on" position when the integrally hinged side wall portion 16***a* is pivoted with the lid 22 from the compartment closed position (FIG. 1) to the compartment open position (FIG. 2).

While details of the chip/switch means 40 have not been shown, they will be well within the ability of one of ordinary skill in the art. It is contemplated that the chip/switch means will include a chip containing the audible telephone ringing signal or sound, a limited capacity battery, a small speaker, and the switch portion of the chip/switch means may advantageously take the form of a reed switch which changes position and, thus, only makes contact when the integrally hinged side wall portion 16*a* has been pivoted with the lid 22 from the compartment closed position to the compartment open position. Generally speaking, however, the details of this feature can take various forms among those that are readily available in the art.

Referring to FIGS. 3–5, the package 10 may also advantageously include an additional recess 46 in the insert 28 for a telephone battery and an additional recess 48 in the insert 28 for a battery charging unit for the telephone battery. The exact size, shape, and spacing of the various recesses 20, 46 and 48 will naturally be understood as conforming to the respective components for any given manufacturer, but, advantageously, they are all spaced from the side wall 16 to protect the various components in the event the side wall 16 is deformed or subject to stress. Similarly, the top of the various components will be protected during shipment by the interposition of the operation manual 36, and at least the telephone 12 will be additionally protected by reason of the false bottom wall 30 described hereinabove.

Referring specifically to FIGS. 4–6, the spring means 38 will be understood to be comprised of a reverse folded strip of corrugated material in which the bottom layer 38*a* may advantageously be secured to the false bottom wall 30, if desired. The strip of corrugated material may be folded in zig-zag fashion substantially as shown such that the top fold 38*b* will have its free end generally adjacent the upper end 12*a* of the telephone 12. With this arrangement, the corrugated strip comprising spring means 38 will cause the upper end 12*a* of the telephone 12 to be automatically elevated as soon as the operation manual 36 has been removed from the compartment 14 substantially as shown in FIG. 4.

As will now be appreciated, the package 10 provides an entirely unique marketing enhancing tool in which the product, such as the telephone 12, is elevated. This causes the just purchased product to visually confront the purchaser to immediately stimulate interest when the lid 22 is moved from the compartment closed position to the compartment open position and, at the same time, an audible signal such as that of a telephone ringing will appeal to the auditory sense of the purchaser. With this stimulation of the senses, both sight and sound, the purchaser will find immediate interest in and satisfaction with his or her product purchase.

While this is occurring, the package 10 will also have served as a very effective means of shipping and presenting the product for sale.

While in the foregoing, there has been set forth a preferred embodiment of the invention, it will be appreciated that the details herein given may be varied by those skilled in the art without departing from the true spirit and scope of the appended claims.

I claim:

1. A package for a plurality of related products, comprising:

a compartment for receiving said products defined at least in part by a side wall and a bottom wall, a recess within said compartment generally conforming in shape to the shape of one of said products, and a lid overlying said compartment to normally restrict access to said products during shipment and sale thereof;

an insert disposed within said compartment to define a false bottom within said compartment, said false bottom being generally spaced above said bottom wall of said compartment, said recess in said compartment being formed in said insert to receive said one of said products;

said lid being movable from a closed compartment position to an open compartment position by a purchaser of said products; and spring means disposed within said recess so as to be under said one of said products for elevating at least a portion of said one of said products from said recess when said lid has been moved from said closed compartment position to said open compartment position to enhance the visibility of said one of said products in said compartment to said purchaser thereof.

2. The product package of claim 1 including means associated with said lid for producing an audible signal relating to said product when said lid has been moved from said closed compartment position to said open compartment position.

3. The product package of claim 1 wherein said compartment is generally rectangular in shape and has an open top, and said side wall defining said compartment includes four side wall portions integral with said bottom wall thereof.

4. The product package of claim 1 wherein said lid is hinged to one of said side wall and said bottom wall defining said compartment for pivoting said lid from said closed compartment position to said open compartment position thereof.

5. A package for a telephone, comprising:

a compartment for receiving said telephone defined at least in part by a side wall and a bottom wall, said compartment having a recess generally conforming in shape to the shape of said telephone, and a lid overlying said compartment to normally restrict access to said telephone during shipment and sale thereof;

said lid being movable from a closed compartment position to an open compartment position by a purchaser of said telephone in order to gain access to said telephone;

means associated with said recess for elevating at least a portion of said telephone from said recess in said compartment when said lid has been moved from said closed compartment position to said open compartment position to enhance the visibility of said telephone in said compartment to said purchaser thereof; and means associated with said lid for producing an audible telephone ringing signal when said lid has been moved from said closed compartment position to said open compartment position.

6. The telephone package of claim 5 wherein said compartment is generally rectangular in shape and has an open top, and said side wall defining said compartment includes four side wall portions integral with said bottom wall thereof.

7. The telephone package of claim 5 wherein said lid is integrally hinged to said side wall defining said compartment in such manner as to be able to pivot said lid from said closed compartment position to said open compartment position thereof.

8. The telephone package of claim 5 including an insert disposed within said compartment and generally conforming to said side wall thereof to provide a false bottom within said compartment generally spaced above said bottom wall thereof.

9. The telephone package of claim 8 wherein said recess in said compartment is formed in said insert defining said false bottom and said elevating means comprises spring means disposed within said recess so as to be under said telephone.

10. A package for a portable cellular telephone, comprising:

a compartment for receiving said telephone defined at least in part by a side wall and a bottom wall, said compartment having a recess generally conforming in shape to the shape of said telephone, and a lid overlying said compartment to normally restrict access to said telephone during shipment and sale thereof;

said compartment being generally rectangular in shape and having an open top and said side wall defining said compartment including four side wall portions integral with said bottom wail thereof, said lid being integrally hinged to one of said side wall portions defining said side wall so as to be able to pivot said lid from a closed compartment position to an open compartment position thereof;

said lid being movable from said closed compartment position to said open compartment position by a purchaser of said telephone in order to gain access to said telephone;

means for automatically elevating at least a portion of said telephone from said recess in said compartment when said lid has been moved from said closed compartment position to said open compartment position in order to enhance the visibility of said telephone in said compartment to said purchaser thereof; and means associated with said lid for automatically producing an audible telephone ringing signal when said lid has been moved from said closed compartment position to said open compartment position.

11. The telephone package of claim 10 wherein said audible means includes chip/switch means for producing said audible telephone ringing signal for a preselected time when said lid is moved to said compartment open position thereof.

12. The telephone package of claim 10 wherein said side wall portion to which said lid is integrally hinged is also integrally hinged to said bottom wall for movement from said compartment closed position to said compartment open position.

13. The telephone package of claim 12 wherein said integrally hinged side wall portion includes opposed accordion side wail folds integral with adjacent side wall portions for movement from a folded, closed position to an expanded, open position.

14. The telephone package of claim 10 wherein said recess is formed in an insert generally conforming to said side wall of said compartment to provide a false bottom for supporting said telephone above said bottom wall of said compartment.

15. The telephone package of claim 14 wherein said elevating means comprises spring means disposed within said recess so as to be disposed between said false bottom and said telephone for elevating one end relative to the other end of said telephone.

16. The telephone package of claim 14 including at least one additional recess in said insert for a telephone battery and also including at least one additional recess in said insert for a battery charging unit for said telephone battery.

17. The telephone package of claim 14 wherein said insert has a top wall disposed intermediate a top edge of said side wall of said compartment and said bottom wall of said compartment for positioning an operation manual over said insert and telephone.

18. A package for a portable cellular telephone, comprising:

a compartment for receiving said telephone defined at least in part by a side wall and a bottom wall, said compartment having a recess generally conforming in shape to the shape of said telephone, and a lid overlying said compartment to normally restrict access to said telephone during shipment and sale thereof;

said compartment being a generally rectangularly shaped box having an open top and said side wall defining said compartment includes four side wall portions integral with and perpendicular to said bottom wall thereof, said lid being integrally hinged to one of said side wall portions defining said side wall so as to be able to pivot said lid from a closed compartment position to an open compartment position thereof;

said recess being formed in an insert generally conforming to said side wall of said compartment to provide a false bottom for supporting said telephone above said bottom wall of said compartment, said lid being movable from said closed compartment position to said open compartment position by a purchaser of said telephone in order to gain access to said telephone supported by said false bottom of said insert, said insert having a top wall disposed intermediate a top edge of said side wall and said bottom wall of said compartment for positioning an operation manual over said top wall of said insert and said telephone;

spring means disposed within said recess in said compartment so as to be disposed between said false bottom and said telephone for automatically elevating one end relative to the other end of said telephone from said recess in said compartment when said lid has been moved from said closed compartment position to said open compartment position in order to enhance the visibility of said telephone in said compartment to said purchaser thereof; and means associated with said lid for automatically producing an audible telephone ringing signal including chip/switch means for producing said audible telephone ringing signal for a preselected time when said lid is moved from said closed compartment position to said open compartment position.

19. The telephone package of claim 18 wherein said side wall portion to which said lid is integrally hinged is also integrally hinged to said bottom wall for movement from said compartment closed position to said compartment open position.

20. The telephone package of claim 19 wherein said integrally hinged side wall portion includes opposed accordion side wall folds integral with adjacent side wall portions for movement from a folded, closed position to an expanded, open position.

21. The telephone package of claim 19 wherein said chip/switch means is integrally disposed in overlapping relation to said integrally hinged side wall portion and said bottom wall for movement from a "switch on" position to a "switch off" position.

22. The telephone package of claim 20 wherein said chip/switch means is in said "switch off" position when said integrally hinged side wall portion is perpendicular to said bottom wall of said compartment in said compartment closed position.

23. The telephone package of claim 20 wherein said chip/switch means is in said "switch on" position when said integrally hinged side wall portion is pivoted with said lid from said compartment closed position to said compartment open position.

* * * * *